United States Patent [19]

Phelon et al.

[11] 4,285,321

[45] Aug. 25, 1981

[54] CAPACITOR DISCHARGE IGNITION SYSTEM

[75] Inventors: Russell D. Phelon, Longmeadow; Bob O. Burson, East Longmeadow, both of Mass.

[73] Assignee: R. E. Phelon Company, Inc., East Longmeadow, Mass.

[21] Appl. No.: 86,340

[22] Filed: Oct. 19, 1979

[51] Int. Cl.[3] ..... F02P 3/08; F02P 3/06

[52] U.S. Cl. ..... 123/599; 123/600; 123/618; 315/209 CD; 315/209 SC

[58] Field of Search ..... 123/148 CC, 148 CA, 123/148 E, 148 F, 149 R, 149 C, 149 D; 315/209 CD, 209 SC, 218; 310/78, 153; 323/596, 599, 600, 618

[56] References Cited

U.S. PATENT DOCUMENTS

| | | | |
|---|---|---|---|
| 3,303,385 | 2/1967 | Staiger | 123/148 CA |
| 3,439,663 | 4/1969 | Lombardini et al. | 123/149 D |
| 3,741,184 | 6/1973 | Tanner et al. | 123/148 R |
| 3,955,549 | 5/1976 | Burson | 123/148 CC |
| 4,036,201 | 7/1977 | Burson | 123/148 CC |
| 4,046,125 | 9/1977 | Mackie | 123/148 CC |
| 4,170,977 | 10/1979 | Carmichael et al. | 123/148 CC |

FOREIGN PATENT DOCUMENTS

| | | | |
|---|---|---|---|
| 2448302 | 4/1975 | Fed. Rep. of Germany | 123/148 CA |

*Primary Examiner*—P. S. Lall

*Attorney, Agent, or Firm*—Chapin, Neal & Dempsey

[57] ABSTRACT

Breakerless capacitor discharge ignition system for internal combustion engines in which a charge coil and ignition coil are disposed on ferromagnetic core. A changing flux is established by rotation of permanent magnets past the core. The charge coil is connected to charge a capacitor in circuit with a silicon controlled rectifier (SCR) for discharging the capacitor through the primary winding of an ignition transformer. The charge coil and transformer are wound on the core such that voltages of opposite polarity are simultaneously induced therein by the changing magnetic flux. A half way voltage of one polarity charges the capacitor and a voltage of opposite polarity induced in the secondary winding by the changing magnetic flux triggers the SCR to its conductive state discharging voltage stored on said capacitor through the primary winding of the ignition coil.

5 Claims, 5 Drawing Figures

CAPACITOR DISCHARGE IGNITION SYSTEM

BACKGROUND OF THE INVENTION

This invention relates to capacitor discharge ignition systems used with spark ignited internal combustion engines and, in particular, to an improvement over the type of ignition system disclosed in Burson U.S. Pat. No. 4,036,201 assigned to the same assignee as this application.

In the Burson patent, a capacitor discharge ignition system is disclosed wherein voltage is developed in the primary winding of the ignition transformer by changing magnetic flux. This voltage is connected to the control electrode or gate of an electronic switch means (SCR) causing the SCR to switch to its conductive state. The primary voltage thus causes the SCR to discharge the voltage stored on a capacitor through the primary winding of the ignition coil. As a result, an ignition pulse is induced in the secondary winding of the ignition coil to provide an ignition spark for the engine.

The present invention, while similar to the Burson patent, involves a tap on the secondary winding of the ignition coil which is connected to the gate of an SCR to cause the latter to be switched to a conductive state whereby voltage stored on a capacitor is discharged through the primary winding of the ignition coil to produce an ignition pulse in the secondary.

The principal object of this invention is to provide an improved capacitor discharge ignition system in which a trigger voltage is derived at least in part from the secondary winding of the ignition coil.

A further object of this invention is to provide a capacitor discharge ignition system of the above type in which the trigger voltage is derived solely from the secondary winding of the ignition coil.

The above and other objects and advantages of this invention will be more readily apparent from the accompanying description read in the light of the following drawings.

DESCRIPTION OF THE PREFERRED EMBODIMENT

Figure 1:
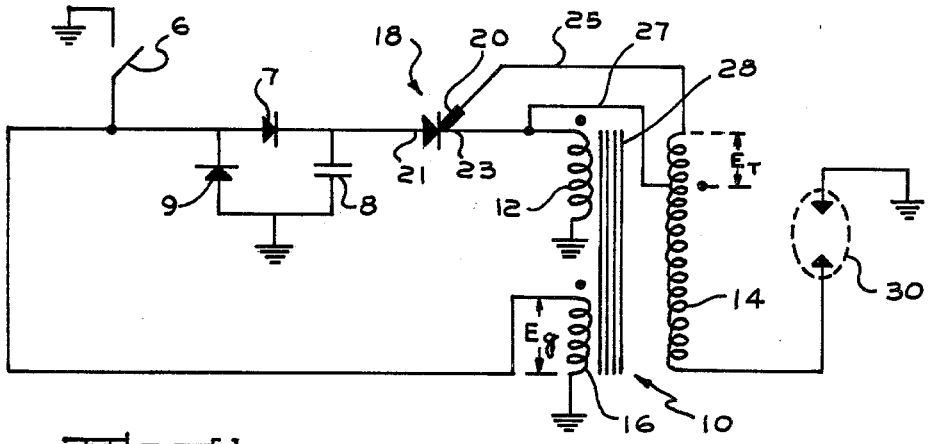
FIG. 1 is a schematic wiring diagram illustrative of this invention.

In FIG. 1 is shown and the preferred embodiment of this invention which comprises a schematic wiring diagram having an ignition switch 6, a storage capacitor 8 connected across the primary winding 12 of an ignition transformer coil shown generally at 10. This coil also includes a secondary winding 14. Charging diodes 7 and blocking diode 9 are poled to enable the capacitor 8 to be fully charged by half wave voltages of one polarity generated by a charging coil 16 in response to changing magnetic flux developed in the core shown schematically at 28. Preferably primary winding 12, secondary winding 14 of the ignition coil and the charge coil 16 are all wound on the same portion of the core so that each is subject to the same changes of magnetic flux at any time during movement past the core of permanent magnet means (not shown) rotated in synchronism with engine operation.

The electronic switch means, such as an SCR 18 is connection with its anode-cathode junction in series with the capacitor 8 and one end of primary winding 12. The SCR includes a gate or control electrode 20, anode 21 and cathode 23 connected in series from the high potential end of the charge coil 16 through diode 7 to the end of the primary winding 12 which connection, as indicated by polarity dots are simultaneously at the same polarity. For purposes of explanation simplicity, it will be assumed that these dots represent a positive potential. The gate of the SCR is connected to the secondary coil 14 by lead 25 and a second lead 27 serves as a tap connecting the secondary coil to the cathode of the SCR. It will be noted that this tap lead 27 is connected to a point on the secondary winding which is at the same polarity as the upper end of the primary winding. The gate 20 is shown connected by lead 25 to a negative potential on the secondary and these polarities bias the SCR to a non-conducting state.

Figure 2:
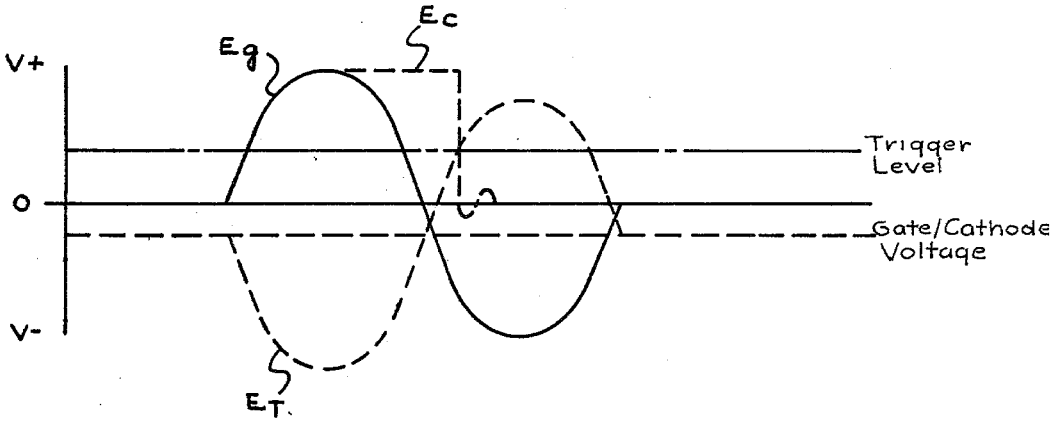
FIG. 2 is a diagram showing the voltages developed during operation of the circuit shown in FIG. 1.

The charge coil 16 and ignition coil 10 are wound on the same core 28 in such directions that as the permanent magnet rotates past the core, the voltage induced in the charge coil comprises half wave voltages of opposite polarity as shown in Eg in FIG. 2. Simultaneously, the voltage generated in the secondary coil is of opposite polarity as shown at Et in FIG. 2. The positive half cycle of the voltage Eg, causes the capacitor 8 to be charged, as shown as Ec, during the complete positive half cycle of the charge voltage. When the polarity of the voltage induced in the charge coil changes to a negative value, the voltage induced in the secondary winding by the rotation of the permanent magnets past the core 28, swings positive. When this secondary voltage, as seen by the gate 20, increases to the predetermined positive trigger level of the SCR, as illustrated in FIG. 2, and the cathode of the SCR sees a negative potential, the SCR is triggered to its conductive state. The capacitor 8 is thus discharged throughout the anode-cathode junction of the SCR into primary winding 12 of the ignition coil. As a result a large voltage is induced in the secondary winding 14 which causes firing of the spark gap 30.

Among the advantages of this ignition system is the fact that no separate trigger coil is needed to fire the SCR. Moreover, since the secondary coil has a large number of turns, it is a relatively simple matter to tap the coil at any predetermined point to obtain a proper trigger voltage output for low speed cut in without changing the transformer winding ratio between the primary and secondary winding of the ignition coil. It will also be realized that this invention provides for economical coil manufacture since one or more tapes may be applied during coil fabrication thus avoiding the necessity of providing additional coils and wiring connections were the secondary not used to provide a trigger voltage.

Figure 3:
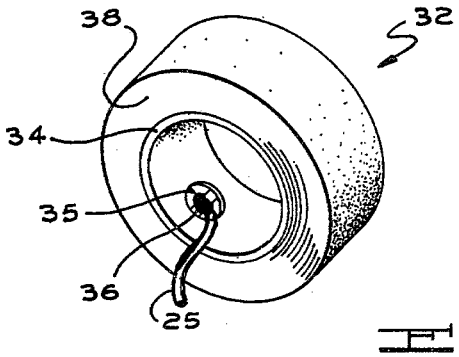
FIG. 3 is a perspective view illustrative of a secondary coil construction of the type wich may be used in carrying out this invention.

The secondary coil, as illustrated at 32 in FIG. 3, is constructed by convolutely winding alternate layers of dielectric paper and copper wire. The inner diameter of the core is preferably tube 34 of relatively stiff paper, plastic or other suitable shape retentive material. A hole 35 is punched through the tube 34 in any desirable axial position to preselect the desired number of secondary turns to be tapped for connection to the gate of the SCR. During the construction of the coil a foil strip 36 may be laid axially along the outer surface of the tube 34 so as to span the hole 35. After the copper wires are wound onto tube with alternate layers of paper 38, it is a simple matter to solder a lead wire 25 to the foil strip to make the electrical connection from the secondary coil to the gate 20 of the SCR.

Figure 4:
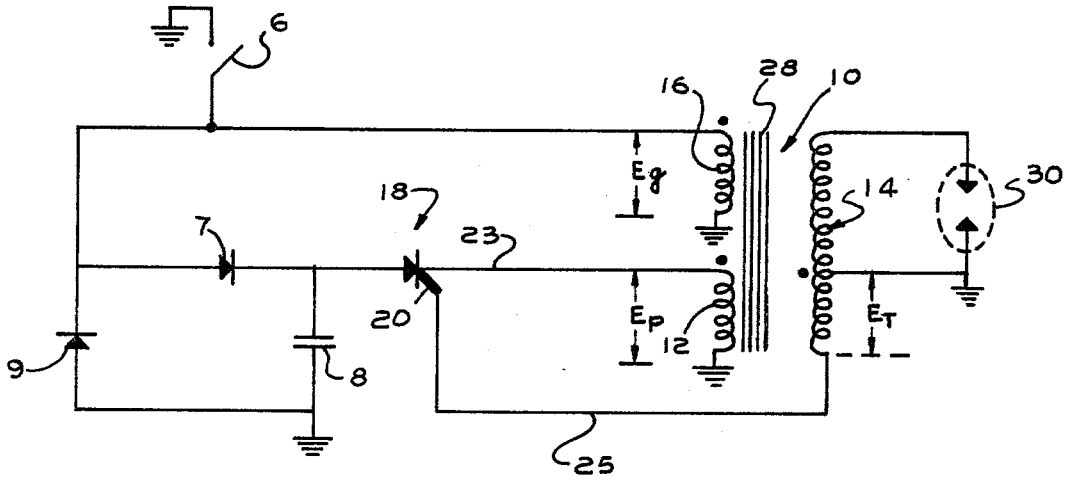
FIG. 4 is a wiring circuit diagram showing an alternative embodiment of this invention.
Figure 5:
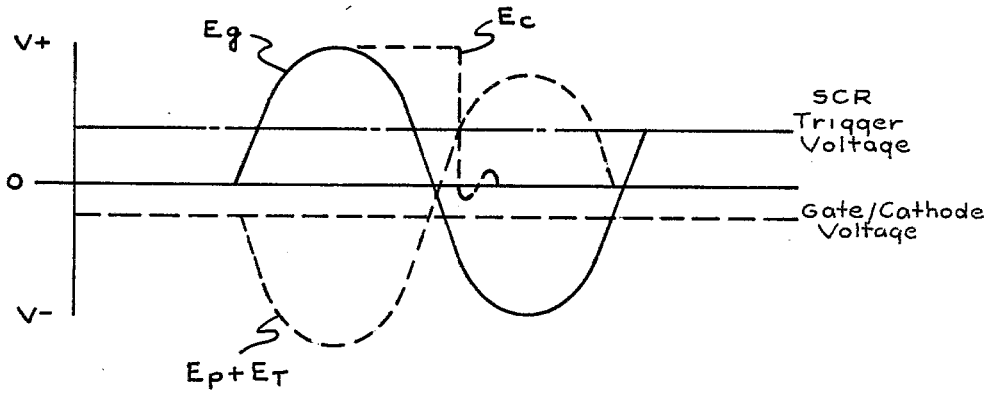
FIG. 5 is a diagram illustrative of voltages developed in the operation of the circuit shown in FIG. 4.

In FIG. 4 is shown an alternate embodiment of the invention wherein the trigger voltage for the SCR is derived in part from the both the primary and secondary windings of the ignition transformer. In general, the same components are used in FIG. 4 as in FIG. 1 and for simplicity are identified in both figures by the same reference numerals. In FIG. 4, the cathode 23 of the SCR 18 is connected to one end of the primary winding 12, shown as having a positive potential and the anode is connected to the end of coil 14 simultaneously of opposite polarity indicated by potential dots adjacent the coils. As the permanent magnet means (not shown) rotates past the ferromagnetic core 28, a variable magnetic flux in the core generates voltage Eg (FIG. 5) in the charge coil which charges the capacitor 8 to voltage Ec. The capacitor remains charged throughout the complete positive half wave pulse induced in the charge coil. As voltage in the charge coil swings to a negative value, the voltage induced in the secondary which is seen by the gate 20 of the SCR becomes positive while the voltage induced in the primary winding 12, as seen by the cathode of the SCR has become negative whereby the SCR is biased to its conductive state by the positive voltage on the gate and negative voltage on the cathode. When this voltage bias reaches its trigger voltage level, the SCR switches to its conductive state and voltage from the capacitor 8 is discharged through the primary winding 12 of the ignition coil whereby by transformer action a large pulse is induced in the secondary winding 14 and an ignition spark is generated across the spark plug 30 to fire the engine.

Having thus described this invention, what is claimed is:

1. In a capacitor discharge ignition system for internal combustion engines having permanent magnetic means, rotatable about a circular path in synchronism with the operation of said machine, a charge coil, a capacitor connected in circuit with said charge coil and an electronic switch means which is rendered conductive in response to a trigger pulse connected to said switch means for discharging said capacitor into the primary winding of a transformer ignition coil, the secondary winding of said transformer ignition coil being connected to a spark gap device for said engine, the improvement in said system comprising an integral core of ferromagnetic material including at least one radially extending leg portion disposed adjacent said circular path, said core providing a path for varying magnetic flux generated by the movement thereby of said magnetic means, said coils being wound on said core such that voltages simultaneously induced therein by said varying flux include half wave voltages of opposite polarity, said capacitor being charged by voltage of one polarity generated in the charge coil and the trigger voltage for said electronic switch being derived at least in part from the secondary winding of said ignition coil, the polarity of the trigger voltage generated in said secondary winding being opposite the polarity of the charge coil whereby said capacitor is charged during one half cycle of voltage induced in the charge coil and discharged during the next half cycle of voltage induced in the secondary coil by said changing flux.

2. A capacitor discharge ignition system as set forth in claim 1 wherein said switch means is an SCR having a gate connected to a point on a secondary coil and said cathode connected to a point on said primary coil, said points being simultaneously of opposite polarity whereby said SCR is triggered by voltage induced in the primary and secondary windings.

3. A capacitor discharge ignition system as set forth in claim 1 in which said switch means is an SCR having a gate connected to a point on said secondary winding and a cathode connected to said primary winding and to another point on said secondary whereby the voltage to trigger said SCR is derived from said secondary winding.

4. A capacitor discharge ignition system as set forth in claim 3 in which said charge coil and ignition coil are wound on one portion of said core wherein the coils are subject to the same changes in magnetic flux throughout the range of operation of said system.

5. A capacitor discharge ignition system as set forth in claim 4 wherein said secondary winding is in the form of convolutely wound coil having alternate layers of wire and insulation, the inner layer of insulation having a hole therethrough and a lead wire connected through said hole to a point on the inner layer of wire, said lead wire serving to connect a voltage pulse to control the operation of said SCR.

* * * * *